US005873572A

United States Patent [19]

Huynh

[11] Patent Number: 5,873,572

[45] Date of Patent: Feb. 23, 1999

[54] METHOD OF PLAYING A WAGERING GAME

[76] Inventor: Hai Q. Huynh, 663 High Glen Dr., San Jose, Calif. 95133

[21] Appl. No.: 944,272

[22] Filed: Oct. 6, 1997

[51] Int. Cl.[6] ..... A63F 1/00

[52] U.S. Cl. ..... 273/292

[58] Field of Search ..... 273/292, 274, 273/309, 303

[56] References Cited

U.S. PATENT DOCUMENTS

| | | | |
|---|---|---|---|
| 5,249,809 | 10/1993 | Wolf | 273/292 X |
| 5,452,900 | 9/1995 | Skratulia et al. | 273/292 |
| 5,496,038 | 3/1996 | Kangsanaraks | 273/292 |
| 5,653,445 | 8/1997 | Quach | 273/292 |
| 5,690,335 | 11/1997 | Skratulia | 273/292 |
| 5,713,573 | 2/1998 | Nazaryan | 273/292 |
| 5,722,661 | 3/1998 | Skratulia et al. | 273/292 |
| 5,725,215 | 3/1998 | Hesse | 273/292 |

*Primary Examiner*—William E. Stoll

*Attorney, Agent, or Firm*—Timothy T. Tyson; Ted Masters; Freilich, Hornbaker & Rosen

[57] ABSTRACT

A method of playing a wagering game 20 between a plurality of players includes dealing four-card hands from a standard 52 card deck to each player, including a player-banker. The cards have numerical values, ace equals one, face cards equal ten, and two through ten equal their respective face values. The players are afforded the opportunity to (a) draw one additional card, or (b) stand with the dealt cards. The object of the game 20 is to have three cards which total to one of ten, twenty, or thirty. The winning hand is then determined by either (a) the fourth card with the highest numerical value, or (b) the least significant digit of the total of the fourth and fifth cards with the highest numerical value. If neither player has three cards which total to one of ten, twenty, or thirty, then the hand is a push and no wager 500 is won by either player.

8 Claims, 6 Drawing Sheets

METHOD OF PLAYING A WAGERING GAME

TECHNICAL FIELD

The present invention pertains generally to games and more particularly to wagering games.

BACKGROUND ART

The present invention constitutes a novel wagering game, entitled "NGAU-10", for which no applicable prior art has been identified. The game has certain superficial similarities to the games of Super Pan-9, California Baccarat, and Pai-Gow Poker, however the objective and playing methodology of the present invention depart significantly from these existing games.

DISCLOSURE OF INVENTION

The present invention is directed to a wagering game which is played by a plurality of players.

In accordance with a preferred embodiment of the invention, the wagering game is played with a deck of cards having established numerical values for each card, the values being, ace equaling one, face cards equaling ten, and cards two through ten equaling their face value.

In accordance with another preferred embodiment of the invention, the game includes a player-banker and a randomly selected action player. The players each place a wager and are dealt four-card hands. The players are then given the opportunity to either (a) draw one additional card, or (b) stand with the dealt cards.

In accordance with another preferred embodiment of the invention, the players sequentially expose and compare hands with the player-banker, and the player with the better hand wins the wager of the player who is not the player-banker. In order to win the wager, a player's hand must have three cards which total to one of ten, twenty, or thirty (this is termed "NGAU"). For four card hands, the ranking of the hand is then determined by the numerical value of the fourth card, highest numerical value being best. For five card hands, the ranking of the hand is determined by the least significant digit of the numerical total of the fourth and fifth cards, highest numerical value being best.

In accordance with an important feature of the invention, if neither player has three cards which total to one of ten, twenty, or thirty, the hand is a push and no wager is won by either player.

In accordance with an important aspect of the invention, the deck of cards is a standard 52-card deck.

In accordance with another important feature of the invention, eight players participate.

In accordance with another important aspect of the invention, the wagers may range between a maximum wager and a minimum wager.

In accordance with another preferred embodiment, the wager of the player-banker forms an initial bank which is reduced each time a wager is won to form a remaining bank. Prior to any exposure and comparison of hands, the remaining bank must be greater than zero, else the hand (wagering round) is ended even though all players may not have participated.

Other features and advantages of the present invention will become apparent from the following detailed description, taken in conjunction with the accompanying drawings, which illustrate, by way of example, the principles of the invention.

Figure 1A:
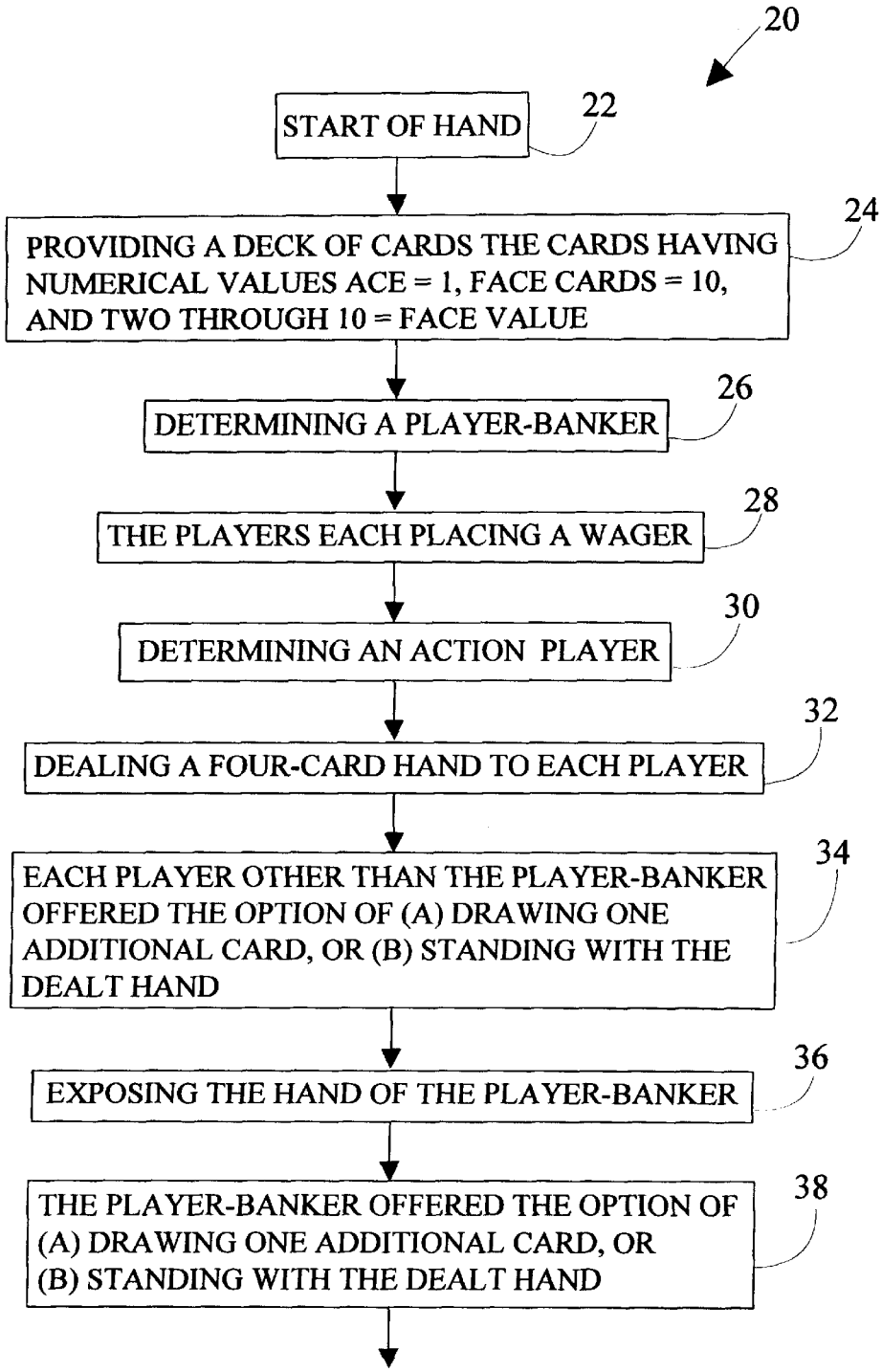
FIG. 1*a* is the start of a flow diagram illustrating the steps and method of play of a game in accordance with the present invention.
Figure 1B:
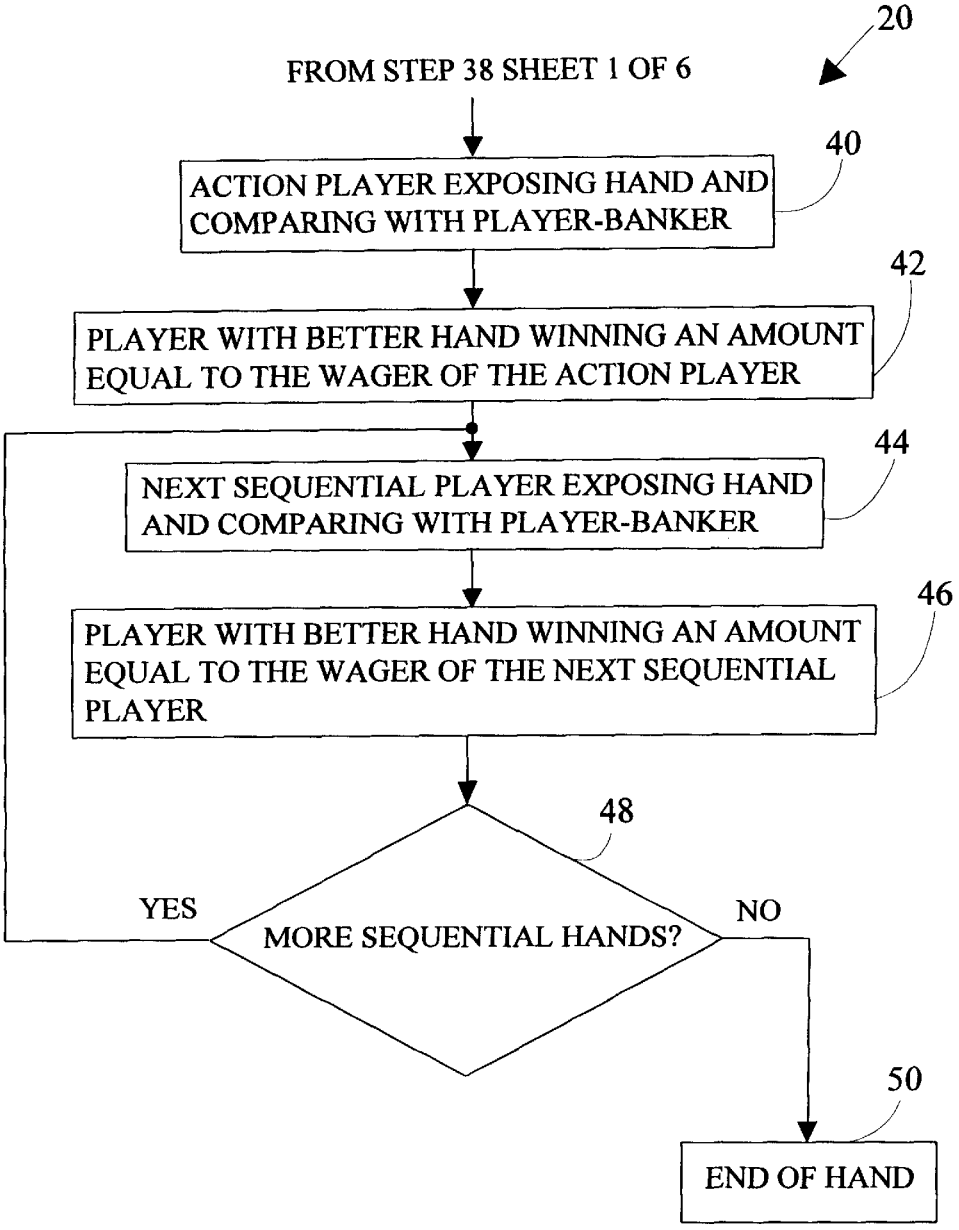
FIG. 1*b* is a continuation of FIG. 1*a;*
Figure 2:
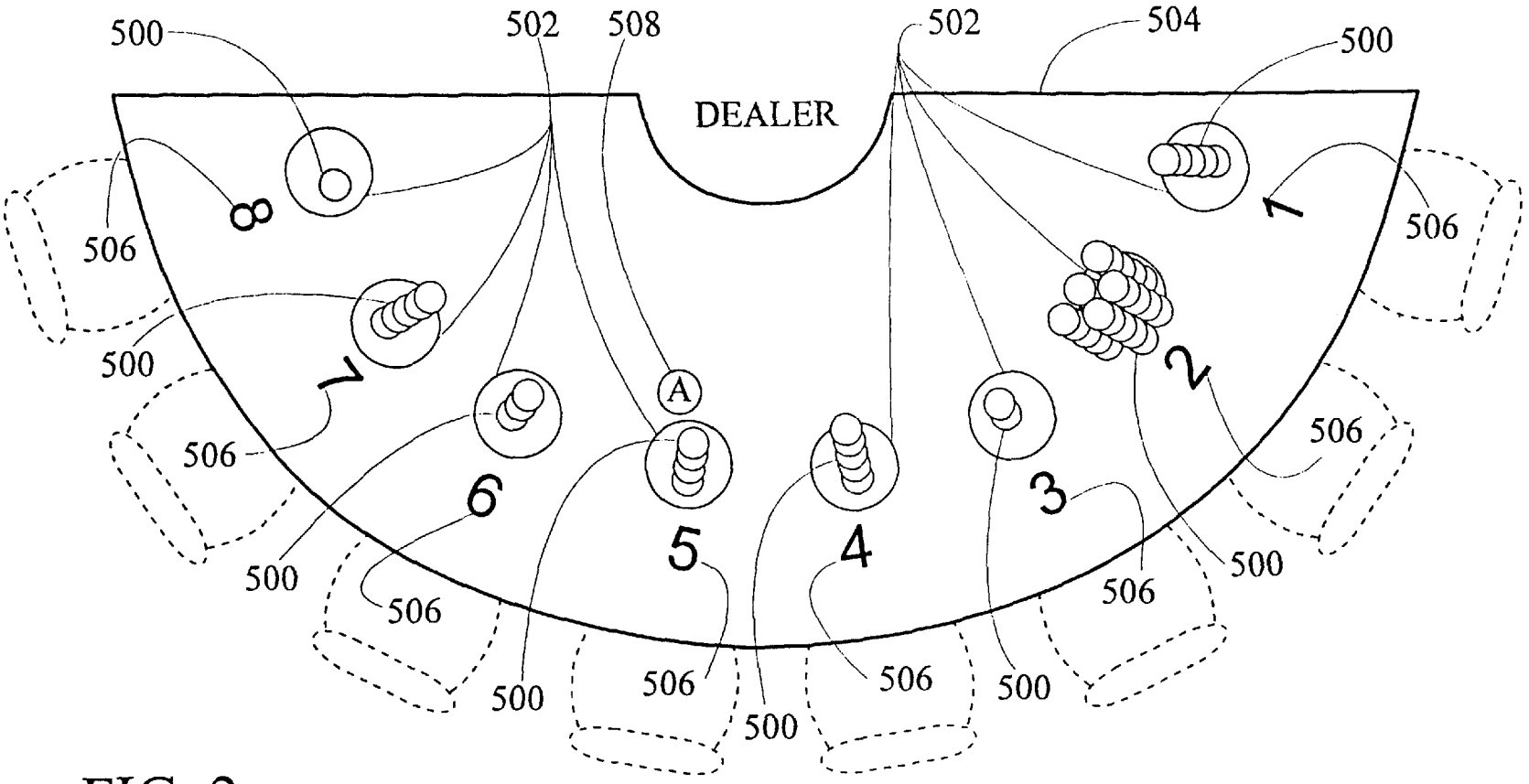
FIG. 2 is a plan view of a playing table layout.

Referring initially to FIG. 1, comprising FIGS. 1*a* and 1*b,* and FIG. 2, there are depicted a flow diagram illustrating the steps and method of play and the table layout, respectively, of a wagering game wherein wagers are apportioned between a plurality of game players utilizing a deck of cards in accordance with the present invention, generally designated as 20. The wagering game includes a plurality of players, eight being preferred, and a non-playing/non-wagering dealer who represents a disenfranchised casino or other gaming establishment.

Referring to FIG. 1, a hand begins with start terminator step 22. In step 24 a deck of cards is provided. In a preferred embodiment, a standard 52 card deck is used, and if the wagering game 20 is dealt from a shoe, any number of decks may be used with nine decks being preferred, for a total of 468 cards. Also in step 24 the cards are assigned numerical values, ace equal to one, face cards equal to ten, and cards two through ten equal to their respective face values. In step 26 a player-banker, also known as a banker, who plays against the other players, is determined. Each player is afforded the opportunity to be the player-banker. After being player-banker for a maximum of two hands (wagering rounds), the opportunity passes to the next player, who may choose to be player-banker or refuse. In step 28 the players including the player-banker each place a wager 500 (refer to FIG. 2). In a preferred embodiment, a collection fee is also contributed by each player to the gaming establishment to pay for the cost of conducting the game 20. The players place their wagers 500 in betting areas 502 directly in front of them on playing table 504. The playing table 504 includes playing positions 506 for a plurality of players, eight in the embodiment shown in FIG. 2. Indicia depicting the betting areas 502, playing positions 506, or other pertinent information can be disposed upon the surface of the playing table 504 or a covering thereof. Depending upon gaming establishment rules, wagers 500 may be of different types. In one embodiment the wager 500 may be for any amount between a maximum and a minimum. In another embodiment, wager 500 may be a spread-limit wager 500 which may be for a maximum amount, a minimum amount, or one of a plurality of predetermined incremental values between the two. For example, $10 (minimum), or $15, or $20, or $25, or $30 (maximum).

The wager 500 of the player-banker differs in concept from those of the other players. In that all players play against the player-banker, the player-banker's wager 500 forms an initial bank and will normally be much greater than the wagers 500 of the other players, and in fact will usually, but not mandatorily, equal the sum of the wagers 500 of all the other players. This is called "covering the table". In the example shown in FIG. 2, the player-banker occupies playing position 2 and has wagered an amount of 25 chips forming a bank which exactly equals the sum of the wagers 500 of the all other players.

In step 30 an action player (position) is randomly selected and an action button 508 is placed in front of the selected player, player 5 in the example shown in FIG. 2. The action player is sometimes also known as the action position or first action player, and is usually the first player to receive cards and expose and compare hands with the player-banker. In a preferred embodiment, the action player selection is accomplished by having the player-banker roll three dice, and then counting out the total of the dice sequentially around the table to determine the action player. It is noted that other action player-determining procedures could also be employed, such as a spinning devices or drawn tokens. Also, the position of the action player could simple rotate around the table for each hand.

In step 32, the dealer sequentially deals four-card hands to each player. In step 34, each player other than the player banker, is sequentially offered the option of (a) drawing one additional card, or (b) standing with the dealt four-card hand. In preferred embodiments, the action player is the first to be dealt cards and offered the drawing option. The direction of sequential action may either be clockwise which is preferred, or counterclockwise. In step 36 the four-card hand of the player-banker is exposed (opened). In step 38 the player-banker is offered the option of (a) drawing one additional card, or (b) standing with the dealt four-card hand. In step 40 the action player exposes and compares hands with the player-banker. In step 42 the player having the better hand (winner) wins an amount equal to the wager 500 of the action player from the other player (loser). The better hand is determined as follows: The objective of the game is to have three cards which total to any one of ten, twenty, or thirty (this is termed "NGAU"), and for four card hands to have the fourth card with the highest numerical value, or for five card hands to have the least significant digit (LSD) of the total of the fourth and fifth cards with the highest numerical value. For example, if the hand of player 1 included the cards ace, king, nine, and seven, the first three cards would total to twenty (one of ten, twenty, or thirty) and the fourth card would therefore give the hand a value of seven. If the hand of player 2, the competing player-banker, included the cards three, five, two, nine, and queen, the first three cards would total to ten (one of ten, twenty, or thirty) and the least significant digit of the total of the fourth and fifth cards (nine plus queen) would give the hand a value of nine and player 2 would win the wager 500 of player 1.

For four card hands, the ranking of the hands from highest value (best) to lowest value (worst) is:

| Hand Contents | Hand Value |
|---|---|
| 4th Card | |
| NGAU plus ten or face card | NGAU-Ten |
| NGAU plus nine | NGAU-9 |
| NGAU plus eight | NGAU-8 |
| NGAU plus seven | NGAU-7 |
| NGAU plus six | NGAU-6 |
| NGAU plus five | NGAU-5 |
| NGAU plus four | NGAU-4 |
| NGAU plus three | NGAU-3 |
| NGAU plus two | NGAU-2 |
| NGAU plus one (ace) | NGAU-1 |
| no NAGU | 0 |

For five card hands, the ranking of the hands from highest value (best) to lowest value (worst) is:

| Hand Contents | LSD of total of 4th & 5th Cards | Hand Value |
|---|---|---|
| NGAU plus | ten | NGAU-Ten |
| NGAU plus | nine | NGAU-9 |
| NGAU plus | eight | NGAU-8 |
| NGAU plus | seven | NGAU-7 |
| NGAU plus | six | NGAU-6 |
| NGAU plus | five | NGAU-5 |
| NGAU plus | four | NGAU-4 |
| NGAU plus | three | NGAU-3 |
| NGAU plus | two | NGAU-2 |
| NGAU plus | one (ace) | NGAU-1 |
| no NAGU | | 0 |

In step 42 (and also step 46 below), if neither player has three cards which total to one of ten, twenty, or thirty, the hand is a push (tie) and no wager 500 is won by either player. Similarly, if both players have identically valued NGAU hands, the hand is a push and no wager 500 is won by either player.

In step 44 the next sequential player exposes and compares hands with the player-banker. In step 46 the player having the better hand, as defined in step 42 above, wins an amount equal to the wager 500 of the next sequential player. In step 48 if there are more sequential players (yes), steps 44, 46, and 48 are repeated until all players have participated. In step 48, if there are no more sequential players (no), the game 20 proceeds to end terminator step 50 and the hand (wagering round) is ended.

Figure 3A:
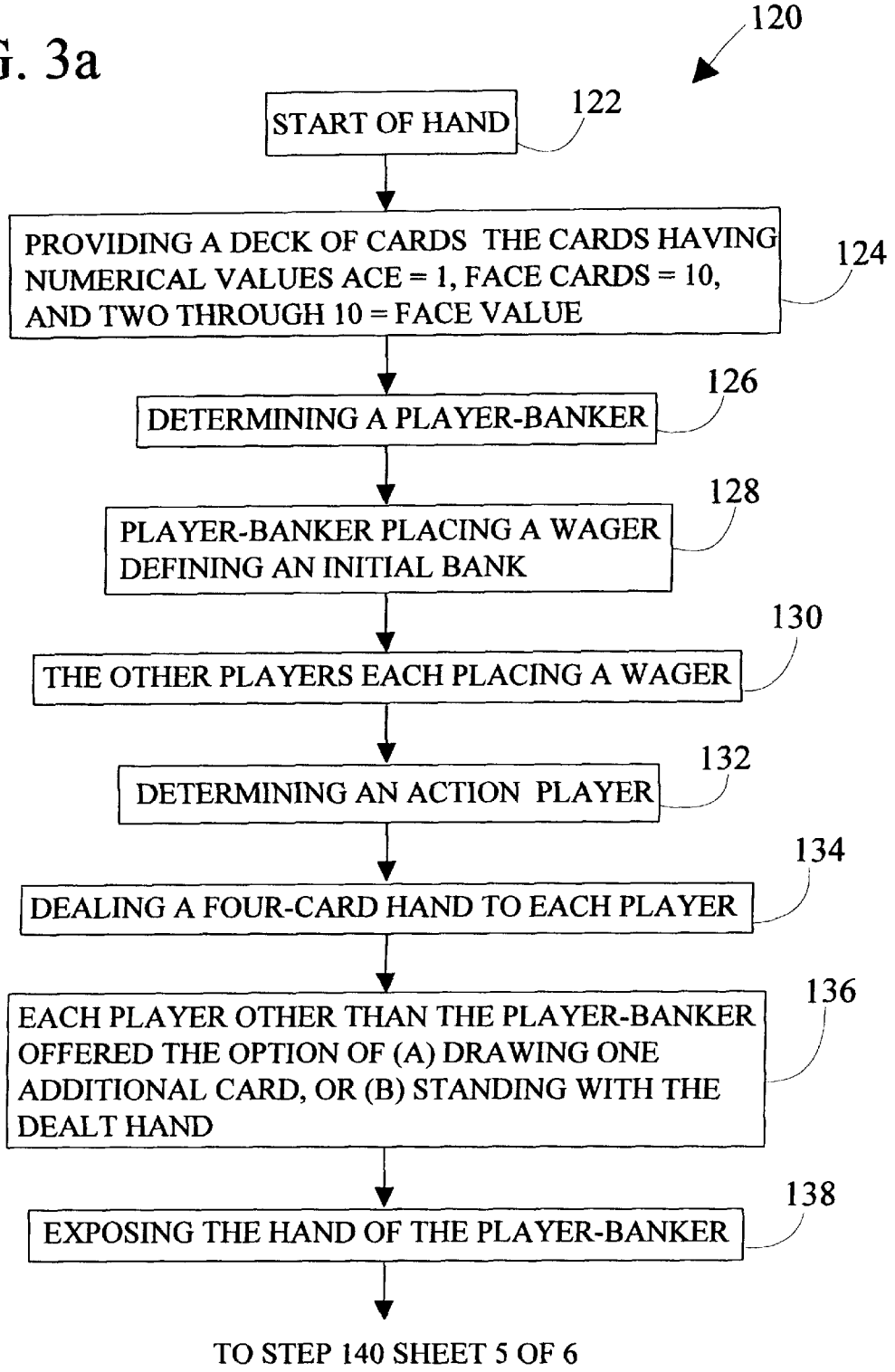
FIG. 3*a* is the start of a flow diagram illustrating the steps and method of play of a second embodiment.
Figure 3B:
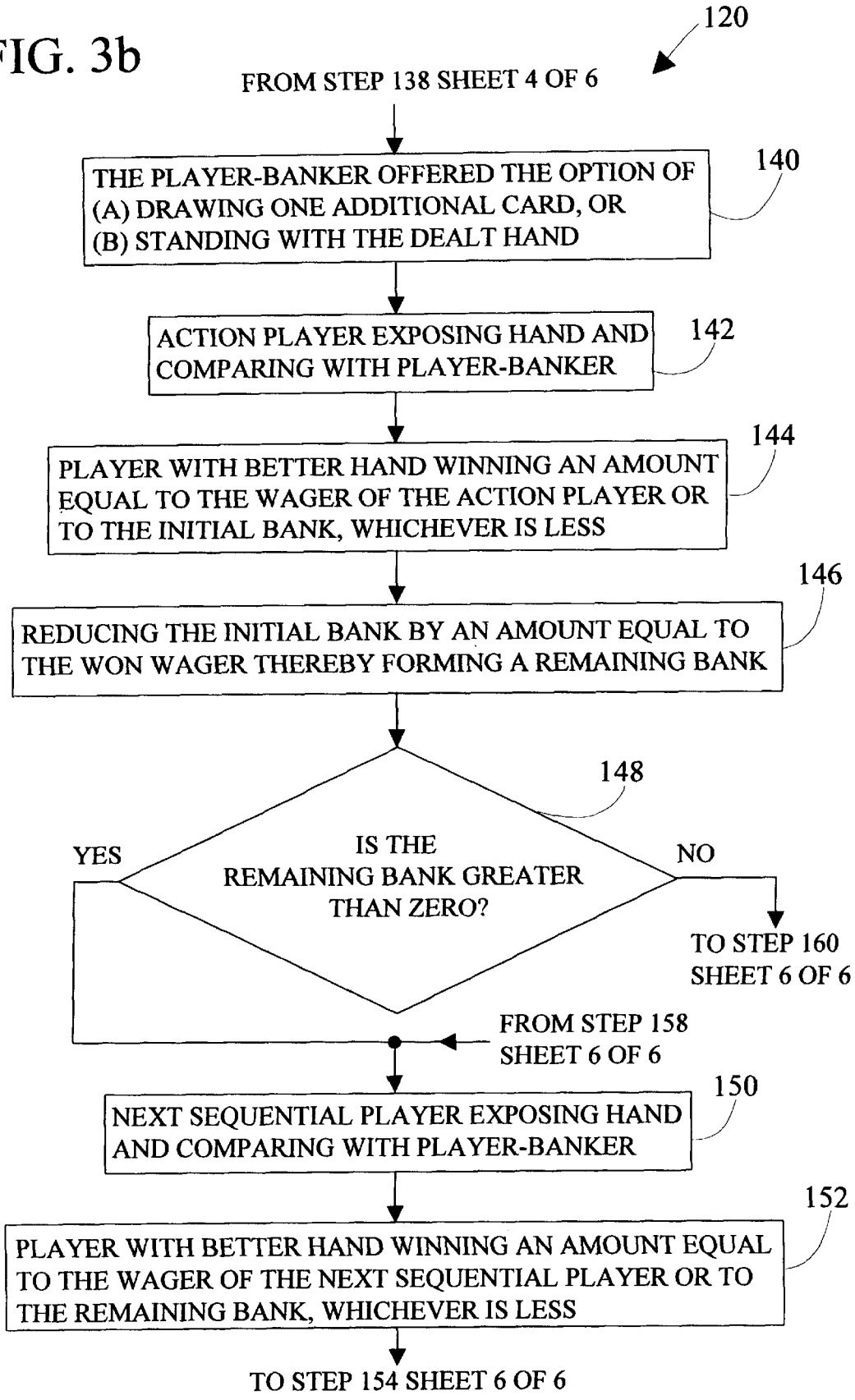
FIG. 3*b* is a continuation of FIG. 3*a;*.
Figure 3C:
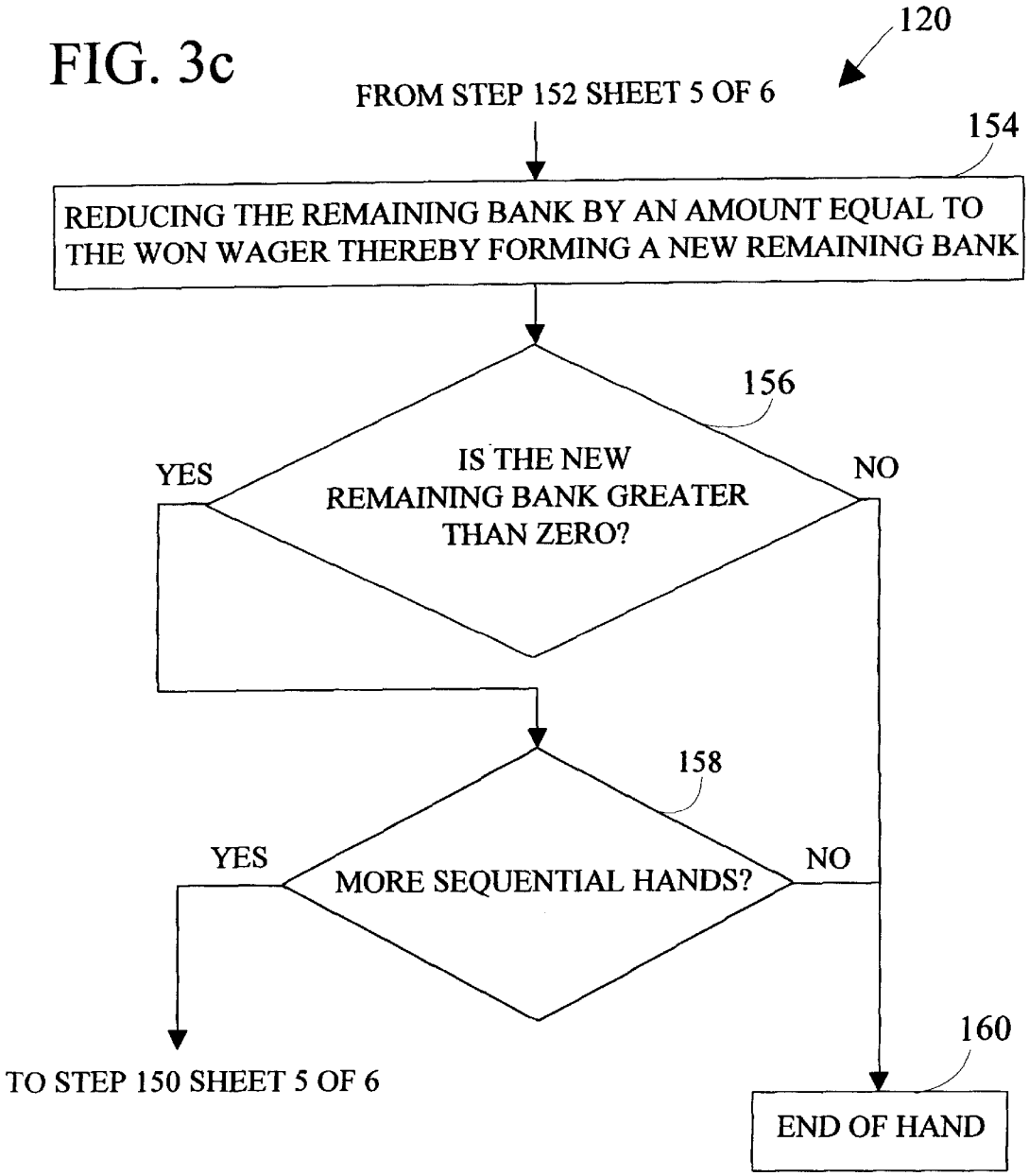
FIG. 3*c* is a continuation of FIGS. 3*a* and 3*b*.

FIG. 3, comprising FIGS. 3*a,* 3*b,* and 3*c* is a flow diagram illustrating the steps and method of play of a second embodiment, generally designated as 120. Wagering game 120 is very similar to previously disclosed wagering game 20, but includes the additional feature of reducing the value of the bank of the player-banker each time a wager 500 is won to form a remaining bank or "amount at risk". Each time a wager 500 is won in steps 144 and 152, the bank of the player-banker is reduced by an amount equal to the won wager 500. Prior to exposing and comparing hands with the next sequential player, the value of the remaining bank must be greater than zero, else the hand (wagering round) is immediately ended even though all players may not have participated.

Referring to FIG. 3, a hand begins with start terminator step 122. In step 124 a deck of cards is provided. In a preferred embodiment, a standard 52 card deck is used, and if the wagering game 120 is dealt from a shoe, any number of decks may be used with nine decks being preferred, for a total of 468 cards. Also in step 124 the cards each have a numerical value, ace equal to one, face cards equal to ten, and cards two through nine equal to their respective face values. In step 126 a player-banker, who plays against the other players, is determined. Each player is afforded the opportunity to be the player-banker. After being player-banker for a maximum of two hands (wagering rounds), the opportunity passes to the next player, who may choose to be player-banker or refuse. In step 128 the player-banker places a wager 500 (refer to FIG. 2) that defines an initial bank. The wager 500 of the player-banker differs in concept from those of the other players. In that all players play against the player-banker, the player-banker's wager 500 forms an initial bank and will normally be much greater than the wagers 500 of the other players, and in fact will usually, but not mandatorily, equal the sum of the wagers 500 of all the other players. This is called "covering the table". In the example shown in FIG. 2, the player-banker occupies playing position 2 and has wagered an amount of 25 chips forming a bank which exactly equals the sum of the wagers 500 of the all other players.

In step 130 the players other than the player-banker each place a wager 500. In a preferred embodiment, a collection fee is also contributed by each player to the gaming establishment to pay for the cost of conducting the game 120. The players place their wagers 500 in betting areas 502 directly in front of them on playing table 504. The playing table 504 includes playing positions 506 for a plurality of players, eight in the shown embodiment. Indicia depicting the betting areas 502, playing positions 506, or other pertinent information can be disposed upon the surface of the playing table 504 or a covering thereof. Depending upon gaming establishment rules, wagers 500 may be of different types. In one embodiment the wager 500 may be for any amount between a maximum and a minimum. In another embodiment, wager 500 may be a spread-limit wager 500 which may be for a maximum amount, a minimum amount, or one of a plurality of predetermined incremental values between the two. For example, $10 (minimum), or $15, or $20, or $25, or $30 (maximum). It is noted that steps 128 and 130 may be reversed wherein the other players place their wagers 500 before the player-banker places a wager 500, or steps 128 and 130 may be performed simultaneously.

In step 132 an action player (position) is randomly selected and an action button 508 is placed in front of the selected player, player 5 in the example shown in FIG. 2. In a preferred embodiment, the action player selection is accomplished by having the player-banker roll three dice, and then counting out the total of the dice sequentially around the table to determine the action player. It is noted that other action player-determining procedures could also be employed, such as a spinning devices or drawn tokens. Also, the position of the action player could simple rotate around the table for each hand.

In step 134, the dealer sequentially deals four-card hands to each player. In step 136, action player, each player other than the player banker, is sequentially offered the option of (a) drawing one additional card, or (b) standing with the dealt four-card hand. In preferred embodiments, the action player is the first to be dealt cards and offered the drawing option. The direction of sequential action may either be clockwise which is preferred, or counterclockwise. In step 138 the four-card hand of the player-banker is exposed (opened). In step 140 the player-banker is offered the option of (a) drawing one additional card, or (b) standing with the dealt four-card hand. In step 142 the action player exposes and compares hands with the player-banker. In step 144 the player having the better hand (winner) wins an amount equal to the wager 500 of the action player or to the initial bank, whichever is less, from the other player (loser). The better hand is determined as follows: The objective of the game is to have three cards which total to one of ten, twenty, or thirty, and for four card hands to have the fourth card with the highest numerical value, or for five card hands to have the least significant digit of the total of the fourth and fifth cards with the highest numerical value. For example, if the hand of player 1 included the cards ace, king, nine, and seven, the first three cards would total to twenty (one of ten, twenty, or thirty) and the fourth card would therefore give the hand a value of seven. If the hand of player 2, the competing player-banker, included the cards three, five, two, nine, and queen, the first three cards would total to ten (one of ten, twenty, or thirty) and the least significant digit of the total of the fourth and fifth cards (nine and queen) would give the hand a value of nine and player 2 would win the wager 500 of player 1.

In step 146 the initial bank of the player-banker is reduced by an amount equal to the won wager 500 thereby forming a remaining bank. In step 148 it is determined if the remaining bank is greater than zero. If the remaining bank is greater than zero, then play continues. If the remaining bank is zero, then the hand (wagering round) is immediately ended in step 160. Also in step 144, if neither player has three cards which total to one of ten, twenty, or thirty, the hand is a push (tie) and no wager 500 is won by either player, and the bank is not reduced in step 146.

In step 150 the next sequential player exposes and compares hands with the player-banker. In step 152 the player having the better hand, as defined in step 144 above, wins an amount equal to the lesser of the wager 500 of the next sequential player or the remaining bank. In step 154 the remaining bank of the player-banker is reduced by an amount equal to the won wager 500 thereby forming a new remaining bank. In step 156 it is determined if the new remaining bank is greater than zero. If the remaining bank is greater than zero, then play continues. If the remaining bank is zero, then the hand (wagering round) is immediately ended in step 160. Also in step 152, if neither player has three cards which total to one of ten, twenty, or thirty, the hand is a push (tie) and no wager 500 is won by either player, and the bank is not reduced in step 154.

In step 158 if there are more sequential players (yes), steps 150 through 158 are repeated until all players have participated. In step 158, if there are no more sequential players (no), the game proceeds to terminator step 160 and the hand (wagering round) is ended.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A method of apportioning wagers between a plurality of game players, comprising the steps of:

providing a deck of cards each card having a numerical value, said values being, ace equals one, face cards equal ten, and cards two through ten equal their face value;

determining a player-banker the players each placing a wager;

determining an action player;

a dealer dealing a four-card hand to each player;

offering each player other than the player-banker the option of selecting one of (a) drawing one additional card, or (b) standing with the dealt cards;

exposing the hand of the player-banker;

offering the player-banker the option of selecting one of (a) drawing one additional card, or (b) standing with the dealt cards;

the action player exposing and comparing hands with the player-banker;

the player having the better hand winning an amount equal to said wager of the action player from the other player, the better hand being the hand in which three of said four cards total to one of ten, twenty, or thirty, and one of (a) the fourth card having the highest numerical value, or (b) the least significant digit of the total of the fourth and fifth cards having the highest numerical value;

the next sequential player exposing and comparing hands with the player-banker;

the player having the better hand winning an amount equal to said wager of the next sequential player from the other player; and, repeating said steps of the next sequential player exposing and comparing hands with the player-banker, and the player with the better hand winning an amount equal to said wager of the next sequential player, until all players have participated.

2. The method according to claim 1, wherein said deck of cards includes a standard 52 card deck.

3. The method according to claim 1, wherein in the steps of the player having the better hand winning an amount equal to said wager of the action player and the player having the better hand winning an amount equal to said wager of the next sequential player, if neither player has three cards which total to one of ten, twenty, or thirty, the hand is a push and no said wager is won by either player.

4. The method according to claim 1, wherein said plurality of game players includes eight players.

5. The method according to claim 1, wherein said step of the players each placing a wager includes each player contributing a collection fee.

6. The method according to claim 1, wherein said wager includes a spread-limit wager having a maximum wager, a minimum wager, and a plurality of predetermined incremental wagers therebetween.

7. The method according to claim 1, wherein said wager may range between a maximum wager and a minimum wager.

8. A method of apportioning wagers between a plurality of game players, comprising the steps of:

providing a deck of cards each card having a numerical value, said values being, ace equals one, face cards equal ten, and cards two through ten equal their face value;

determining a player-banker the player-banker placing a wager defining an initial bank;

the players other than the player-banker each placing a wager;

determining an action player;

a dealer dealing a four-card hand to each player;

action player offering each player other than the player-banker the option of selecting one of (a) drawing one additional card, or (b) standing with the dealt cards;

exposing the hand of the player-banker;

offering the player-banker the option of selecting one of (a) drawing one additional card, or (b) standing with the dealt cards;

the action player exposing and comparing hands with the player-banker;

the player having the better hand winning an amount equal to the lesser of said wager of the action player or said initial bank from the other player, the better hand being the hand in which three of said four cards total to one of ten, twenty, or thirty, and one of (a) the fourth card having the highest numerical value, or (b) the least significant digit of the total of the fourth and fifth cards having the highest numerical value;

reducing said initial bank by the amount of said won wager thereby forming a remaining bank;

ensuring that said remaining bank is greater than zero, else ending the hand;

the next sequential player exposing and comparing hands with the player-banker;

the player having the better hand winning an amount equal to the lesser of said wager of the next sequential player or said remaining bank from the other player;

reducing said remaining bank by the amount of said won wager thereby forming a new remaining bank;

ensuring that said new remaining bank is greater than zero, else ending the hand; and, repeating said steps of the next sequential player exposing and comparing hands with the player-banker, and the player with the better hand winning an amount equal to the lesser of said wager of the next sequential player or said new remaining bank, and reducing said new remaining bank by the amount of said won wager, and ensuring that said new remaining bank is greater than zero else ending the hand, until all players have participated.

* * * * *